US007484777B2

(12) United States Patent
Condo et al.

(10) Patent No.: US 7,484,777 B2
(45) Date of Patent: Feb. 3, 2009

(54) ELECTRONIC PUSH RETRACTION EXIT DEVICE

(75) Inventors: Mark A. Condo, Seymour, CT (US); Darren C. Eller, East Lyme, CT (US); Jon Hulse, Wethersfield, CT (US); Kosta G. Karachristos, Hamden, CT (US); Dale Martin, East Lyme, CT (US); Brett E. Tannone, Newtown, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 11/428,029

(22) Filed: Jun. 30, 2006

(65) Prior Publication Data

US 2008/0012350 A1 Jan. 17, 2008

(51) Int. Cl.
*E05B 65/10* (2006.01)
*E05C 3/06* (2006.01)

(52) U.S. Cl. ..... 292/92; 70/92; 292/DIG. 62

(58) Field of Classification Search ..... 292/92–94, 292/DIG. 62; 70/92, 276, 263
See application file for complete search history.

(56) References Cited

U.S. PATENT DOCUMENTS 3,614,145 A * 10/1971 Zawadzki ..... 292/92
3,722,938 A 3/1973 Bauer et al.
3,767,238 A * 10/1973 Zawadzki ..... 292/21
3,854,763 A * 12/1974 Zawadzki et al. ..... 292/201
3,877,262 A * 4/1975 Williams ..... 70/92
4,145,900 A 3/1979 Ohno
4,384,738 A 5/1983 Floyd
5,033,282 A * 7/1991 Gartner et al. ..... 70/278.7
5,410,301 A * 4/1995 Dawson et al. ..... 340/5.33
5,531,492 A 7/1996 Raskevicius
5,727,406 A 3/1998 Banducci
6,104,594 A 8/2000 Frolov et al.
6,189,939 B1 2/2001 Zehrung
6,386,597 B1 * 5/2002 Walsh, III ..... 292/92
6,394,508 B1 * 5/2002 Zehrung ..... 292/92
6,655,180 B2 * 12/2003 Gokcebay et al. ..... 70/432
6,769,723 B2 * 8/2004 Cohrs et al. ..... 292/92
2004/0227353 A1 * 11/2004 Cohrs et al. ..... 292/92
2005/0261804 A1 * 11/2005 Doty et al. ..... 700/275

OTHER PUBLICATIONS

Sargent Manufacturing Company, 56-Electronic Latch Retraction Exit Device.

* cited by examiner

*Primary Examiner*—Patricia L Engle
*Assistant Examiner*—Alyson M Merlino
(74) *Attorney, Agent, or Firm*—DeLio & Peterson, LLC

(57) ABSTRACT

An electronic push retraction exit device includes a support rail, a push rail and a latch mechanism having a latch bolt operably connected to the push rail and movable between latched and unlatched positions. A control circuit in the exit device drives a linear actuator to retract and hold the push rail and the latch bolt in the unlatched position. The linear actuator preferably includes a stepping motor and is connected to the push rail through a lost motion connection allowing the exit device to be mechanically operated without moving the linear actuator. The control circuit preferably includes an electrical adjustment for the retraction distance of the latch bolt and an adjustable relatch timer. The exit device may be operated by a remote switch attached to a control connection, which may be permanently closed to simulate a prior art electrically operated exit device for compatibility with third party control systems.

28 Claims, 5 Drawing Sheets

ELECTRONIC PUSH RETRACTION EXIT DEVICE

BACKGROUND OF THE INVENTION

1. Field of the Invention

The present invention generally relates to electronically operated exit devices in which an electrical signal causes the exit device to retract the latch bolt.

2. Description of Related Art

An "exit device" is a lock mechanism installed on the inside of an exit door that swings outward. The exit device is designed to allow exit without prior knowledge of how the lock operates, whenever a horizontal force is applied to a pushbar or push rail actuator. The term "push rail" will be used herein to refer to all types of exit device actuators, including pushbars and paddles.

The horizontal pressure required to open the door may be applied to the push rail by anyone who understands how the door operates. However, the design of an exit device is such that the required opening pressure is automatically applied to the push rail as the result of contact between the push rail door actuator and people in a crowd during an emergency.

Exit devices are typically required by fire or building codes and are used in public buildings where many people may be gathered, to reliably allow rapid, safe and easy egress in case of emergency. Exit devices ensure that an exit door is free to operate from the inside of the locked area, yet they allow the exit door to remain locked to prevent unauthorized entry from the outside.

Electronically operated exit devices are often used in access control applications where they are activated by a card reader or keypad from the outside to allow access through a door that also serves as an exit door from the interior space. When the exit device is latched, the exit door cannot be opened from the outside, but it can easily be opened by pressure on the push rail or pushbar of the exit device from the inside. Other applications for electronic exit devices include operation in conjunction with power door operators, allowing the latch to retract in a timed sequence with the door operator and in facilities that are locked and unlocked on a timed schedule, such as a school. The electrical control for the exit device may be integrated into a fire detection system.

The simplest conventional electronically operated exit devices only retract the latch bolt and do not move the push rail when electrically operated. Because the push rail actuator is in the same position when the latch bolt is electrically retracted (door unlocked) and when the latch bolt is extended (door locked) the position of the push rail actuator cannot be used as a visual indication of the locked or unlocked status of the door. It is difficult to tell whether the door is locked or unlocked without actually opening the door.

Designs that retract only the latch bolt have a related problem in high traffic applications, such as a school. In these installations, when the latch bolt is electrically retracted, the push rail will still move each time it is pressed to exit through the door. The door may be opened many times during the day while the latch bolt is electrically retracted, and the constant motion of the push rail actuator and the mechanical actuator elements produces unnecessary wear on those components.

Another problem resides in prior art designs that use a solenoid to retract the latch bolt. A solenoid requires a relatively high in-rush current to reliably retract the latch bolt and overcome initial friction. Because the exit device is mounted on a movable exit door, this relatively high level of current must pass through a hinge or other flexible electrical connection designed to carry that level of current. Such electrical hinges are significantly more expensive than hinges that carry lower power as needed to power card readers, sensors and other low power and low voltage devices found on exit doors. Moreover, the power supply required to meet the high in-rush current requirements of these designs is relatively expensive.

Still another problem with high power solenoid retraction designs is that the solenoid produces significant noise when it is actuated. This noise is objectionable in many settings, such as hospitals and libraries.

Another known design for an electrically operated exit device uses a motor and a cam to electrically retract the push rail. The motor drives the cam, which pulls back the push rail and retracts the latch bolt. A switch detects when the push rail reaches the fully retracted position and turns off the motor drive. A low power solenoid magnetically holds an armature mounted on the push rail to keep the push rail in the fully retracted position until power is removed and the push rail is released.

In this design, the motor does not shut off until the push rail is fully retracted, as sensed by the switch. When the exit device drives other components, such as vertical rods, binding in the additional components can prevent the motor from moving the push rail to the fully retracted position. This produces a continuous drive to the motor, which can ultimately burn it out, break other components or burn out the control circuitry for the motor.

The design described above requires numerous components, including the motor and the holding solenoid. It would be desirable to reduce the number of components to reduce cost.

Another problem with existing electronic exit device designs is that they are mechanically difficult to adjust for correct operation. It would be desirable to be able to electrically adjust the distance the latch bolt moves to allow adjustment during installation and to adjust for wear during the life of the product.

Still another difficulty with conventional electronic exit device designs relates to controlling the time delay before the exit device releases the latch bolt and relatches after it has been electrically unlatched. In some cases, this time delay control is found in a separate external electrical control system, which simply supplies power to open the exit device and removes it to relatch. These separate external electrical control systems add expense.

In other cases the time to relatch is controlled by an integrated time delayed solenoid in the exit device. Changing the time delay requires changing the solenoid, which is difficult and expensive. Moreover, designs that use an integrated time delay are often incompatible with separate external electrical control systems. It would be desirable to have a system with an integrated electrical control of the time to relatch that is compatible with existing external electrical control systems.

SUMMARY OF THE INVENTION

The above and other objects, which will be apparent to those skilled in the art, are achieved in the present invention which is directed to an electronic push retraction exit device for latching and unlatching a door. The exit device includes a support rail mountable to the door, a push rail mounted on the support rail and movable between an outward position and an inward position, a latch bolt operably connected to the push rail and movable between a latched position and an unlatched position, a linear actuator connected to move the push rail and a control circuit for controlling the linear actuator.

The push rail is biased towards the outward position and can be moved to the inward position in the conventional manner by manually pushing on an exterior surface of the push rail. The push rail is connected to move the latch bolt to the unlatched position when the push rail is moved to the inward position. The linear actuator and control circuit have a driving state, an off state and a holding state.

In the driving state the linear actuator moves the push rail towards the inward position. In the off state the linear actuator allows the push rail to return to the biased outward position. In the holding state the linear actuator remains at a constant linear position and prevents the push rail from returning to the biased outward position.

In the preferred design, the linear actuator includes a stepping motor and the control circuit provides a sequence of electrical steps to drive the stepping motor in the driving state. In the holding state the control circuit merely holds the stepping motor at a single step position. In the off state the control circuit removes power from the stepping motor, which releases the biased push rail to return to the outward position.

In one aspect of the invention, the linear actuator moves a shaft connected to the push rail through a lost motion connection. The lost motion connection allows the push rail to move to the inward position when pressure is manually applied to the exterior surface of the push rail, but does not require any corresponding motion of the linear actuator.

In another aspect of the invention the linear actuator is connected to a rocker lever connected between the support rail and the push rail and the lost motion connection is formed by a retractor with an opening, the opening engaging a pin in the rocker lever and allowing lost motion between the push rail and the linear actuator.

In still another aspect of the invention the shaft includes a splined section extending through a correspondingly shaped splined opening, which prevents the shaft from rotating.

In the most highly preferred embodiment of the invention, the control circuit includes an actuator distance adjustment, which allows adjustment of the distance the linear actuator moves and correspondingly controls the distance the push rail and the latch bolt are moved. In the design wherein the linear actuator includes a stepping motor, the actuator distance adjustment varies the number of steps sent to the stepping motor by the control circuit.

In another preferred aspect of the invention, the control circuit also includes an adjustable relatch timer which relatches the exit device after an adjustable delay interval by entering the off state and allowing the latch bolt and push rail to return to the extended positions. A connector is provided to connect the control circuit to power and a remote switch. The connector includes a power connection and a control connection, the control circuit moving the push rail to the inward position and the latch bolt to the unlatched position responsive to an input signal provided by the remote switch at the control connection.

In the preferred design, the control connection may be semi-permanently closed and the power connection may be used to unlatch and relatch the exit device by supplying or removing power. This allows simulation of the operation of prior art exit devices that lack the control connection and relatch timer features of the present invention.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-8 of the drawings in which like numerals refer to like features of the invention.

Figures 1, 2:
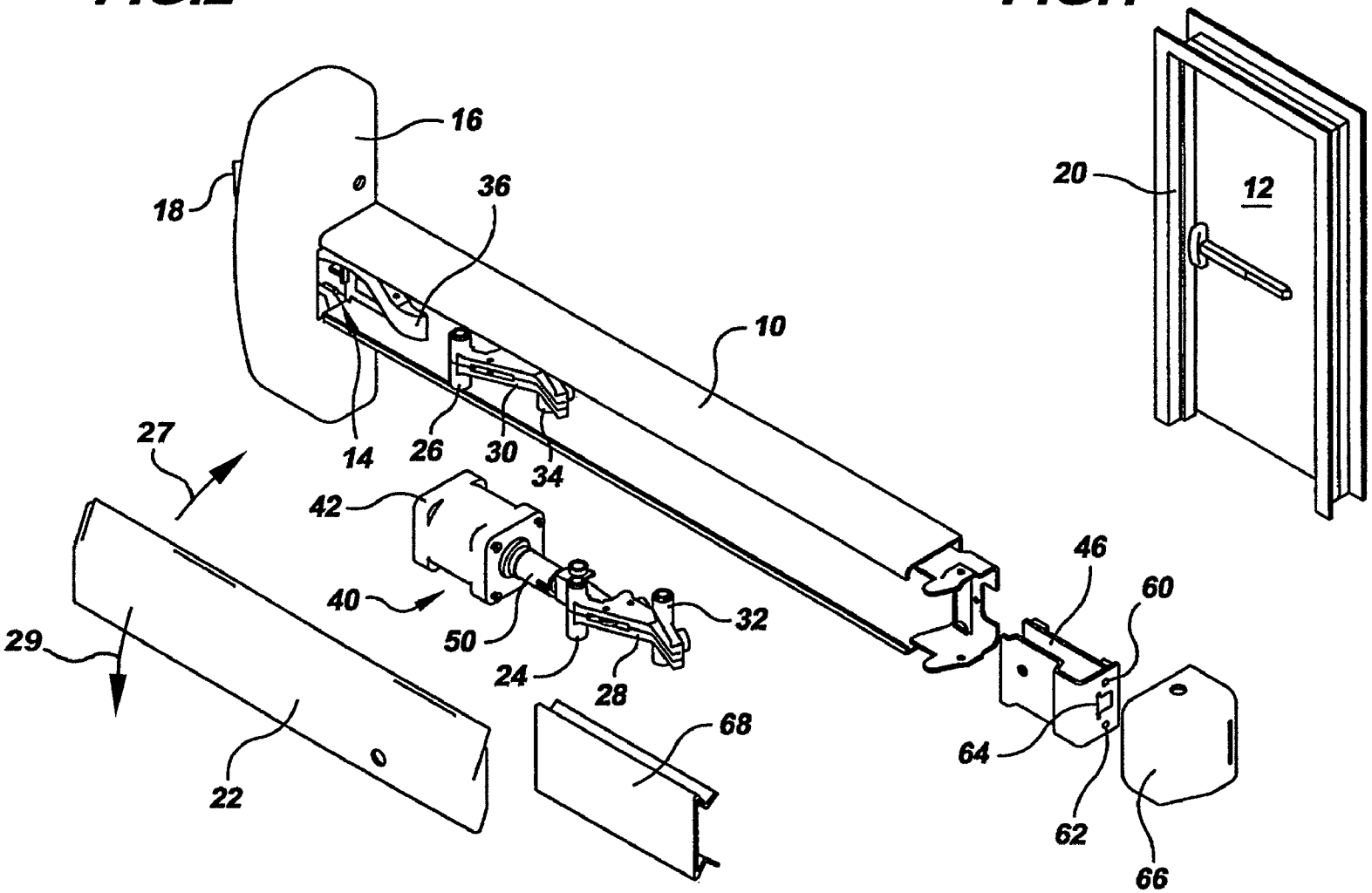
FIG. 1 is a perspective view from the front and upper right showing an electronic push retraction exit device according to the present invention installed on an exit door.
FIG. 2 is an exploded perspective view, also from the front and upper right, of the electronic push retraction exit device seen in FIG. 1. The linear actuator and a portion of the actuating mechanism attached thereto have been moved outward from the base of the exit device.

Referring to FIGS. 1 and 2, the present invention includes a support rail 10 mounted on an exit door 12. A latch mechanism 14 mounted within a latch housing 16 is located at one end of the support rail and includes a latch bolt 18 that engages doorframe 20 to latch and unlatch the exit door. When push rail 22 is pressed horizontally inward towards the support rail in the direction shown with arrow 27, it operates the latch mechanism 14 and retracts the latch bolt 18 so that the exit door can be opened. The push rail 22 and latch mechanism are biased outward so that when the push rail is released it can move outward relative to the support rail (in the direction shown with arrow 29) and the latch bolt 18 extends outward to relatch the exit door.

Push rail 22 is mounted to the support rail 10 with rocker levers 28 and 30 so that the push rail can move towards and away from the support rail as the rocker levers rotate on their respective bearings 32 and 34. The push rail is mounted on the ends of the rocker levers 28 and 30 via bearings 24 and 26. The rocker levers 28 and 30 are mounted on the support rail through bearings 32 and 34.

Bearings 32 and 34 allow the rocker levers to pivot relative to the support rail 10. The support rail holds the bearings 32 and 34 a constant distance apart. In a similar manner, the bearings 24 and 26 allow the ends of the rocker levers to pivot relative to the push rail 22, which holds them the same constant distance apart. This design ensures that the line between bearings 24 and 26 is always parallel to the line between bearings 32 and 34. The result is that push rail 22 is always held parallel to the support rail, but can move towards and away from the support rail 10 as the rocker levers rotate on their bearings.

Figure 3:
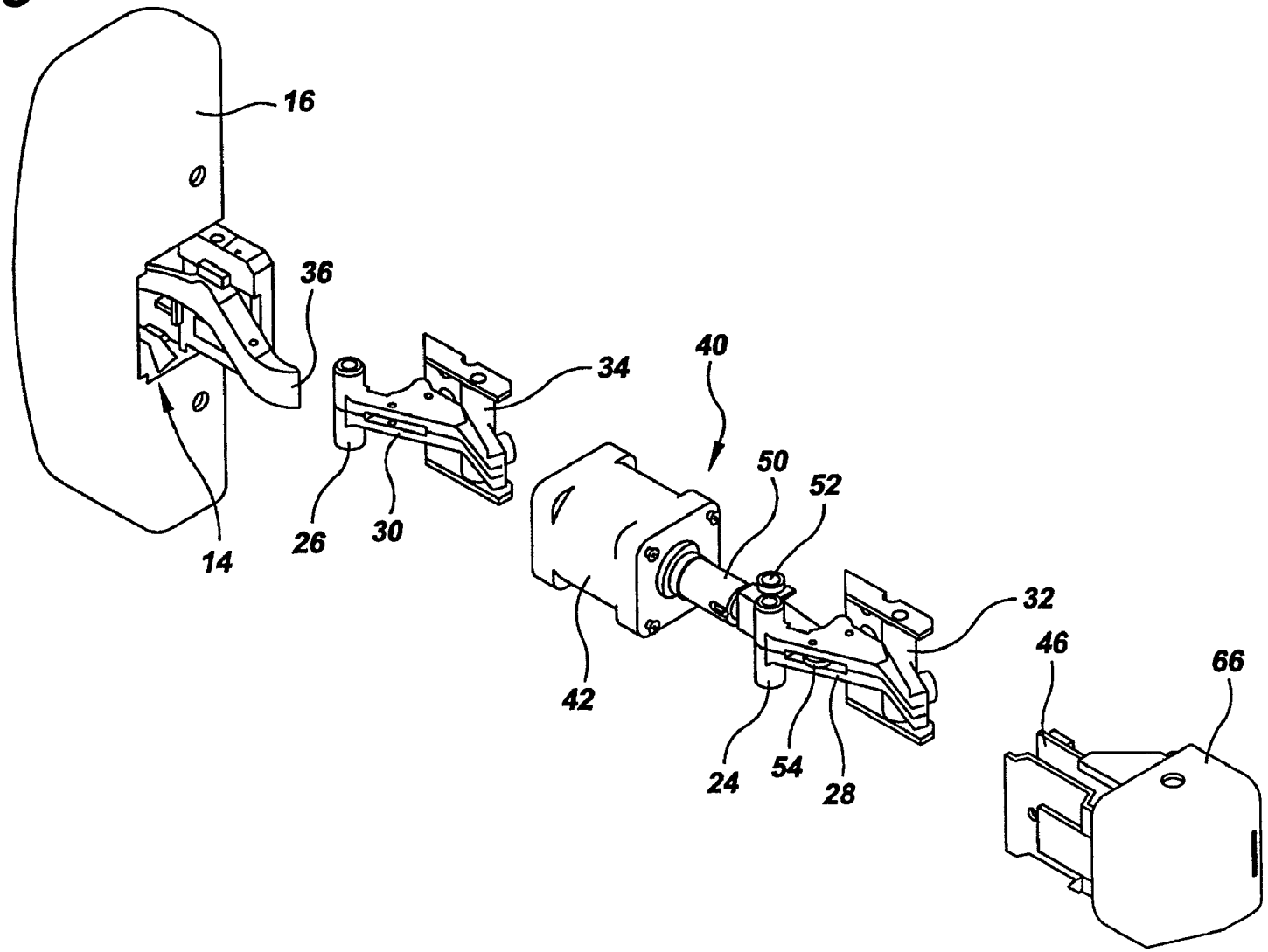
FIG. 3 is another perspective view of the electronic push retraction exit device seen in FIG. 2 with the push rail and base being removed to more clearly show the linear actuator and the actuating mechanism of the exit device. The end cap and control circuit, the actuating mechanism, the linear actuator and the latch mechanism are all in their correct linear relationship and have been shown in the electrically retracted position.
Figure 5:
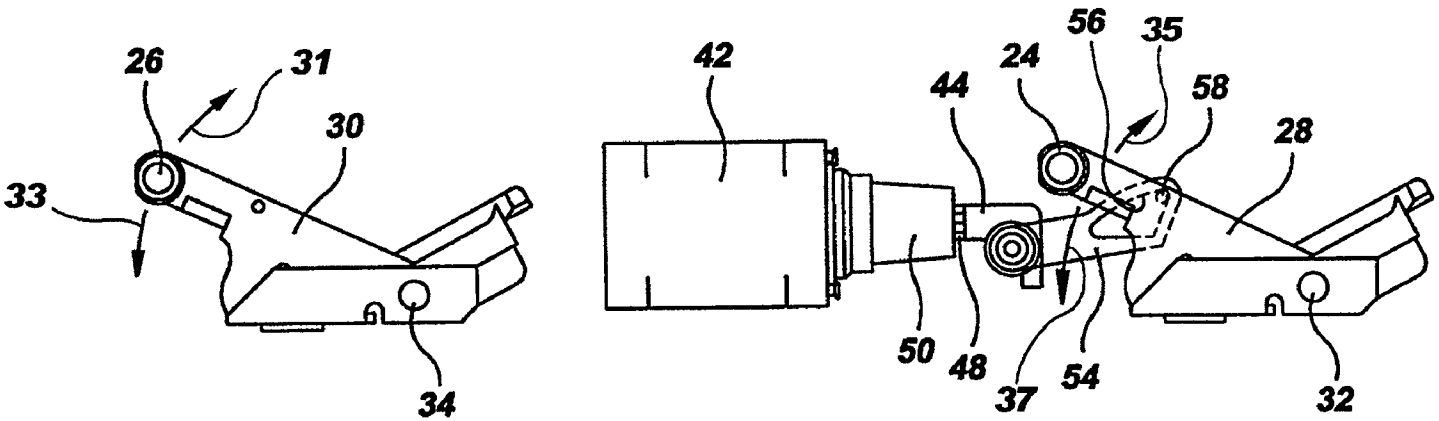
FIG. 5 is a bottom plan view of the encircled components seen in FIG. 4, shown at an enlarged scale. The components are still in the electrically retracted position and hidden portions of the invention have been shown in phantom.
Figure 8:
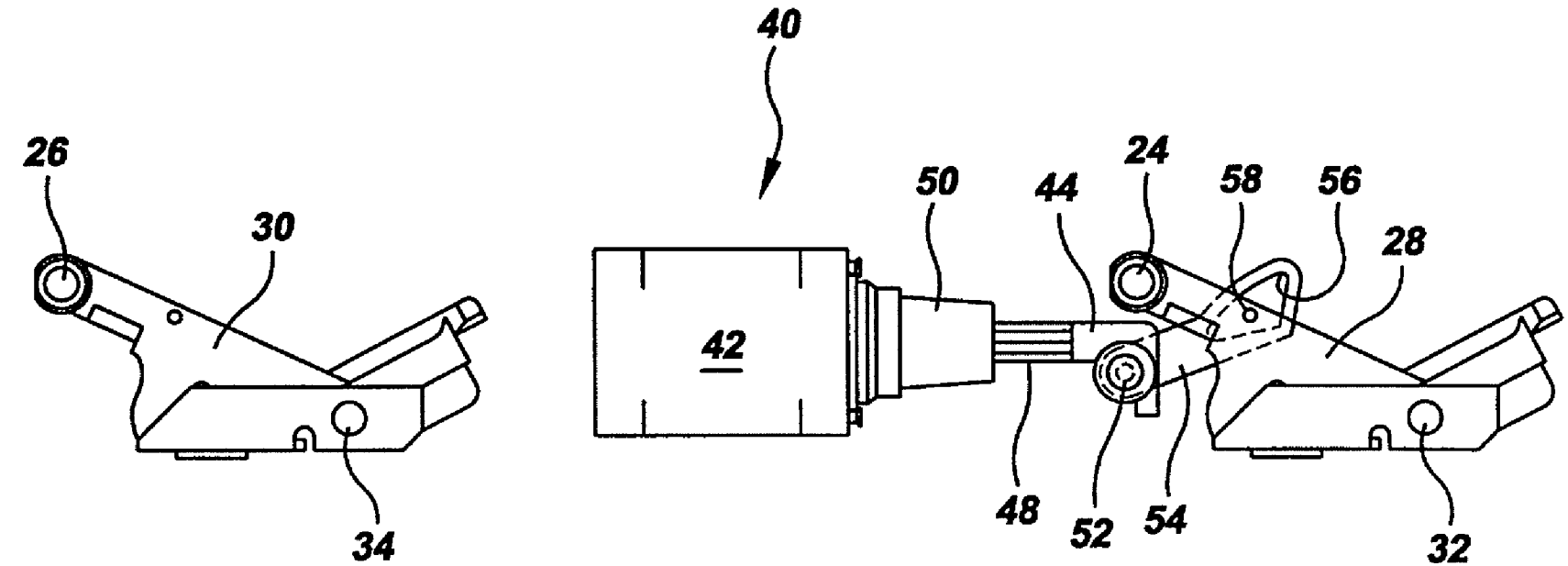
FIG. 8 is a bottom plan view showing the same components seen in FIG. 5, except the exit device is electrically not retracted and mechanically partially retracted.

It should be noted that in FIG. 2, rocker lever 28 has been moved outward from its normal mounted position on the support rail 10 to show it more clearly. FIGS. 3, 5 and 8 show the rocker levers 28 and 30 in their correct aligned position.

As the push rail 22 is pressed inward, rocker levers 28, 30, rotate in synchronism around their respective bearings 32 and 34 and the push rail presses inward on latch lever 36. Inward motion of the push rail 22 moves rocker lever 30 in the direction shown with arrow 33 and moves rocker lever 28 in the direction shown with arrow 37 (see FIGS. 4 and 5). Outward motion of the push rail 22 moves rocker lever 30 in the direction shown with arrow 31 and moves rocker lever 28 in the direction shown with arrow 35. The latch lever 36 actuates the latch mechanism 14 to retract latch bolt 18. The latch mechanism 14 spring biases the latch lever 36 and the latch bolt 18 to the outward position such that unless the push rail 22 is constantly held horizontally inwards, the latch bolt 18 will be automatically extended outwards and returned to the latched position.

The above-described components allow the exit device to be manually operated by pressing the push rail 22 inwards. When the push rail is released, it returns to the outwardly extended position, which also extends and relatches the latch bolt. In addition to this manual operation, however, the present invention may be electrically operated via a linear actuator 40 operated by control circuit 46 (see FIGS. 2 and 3).

The linear actuator 40 includes a motor 42, which drives a shaft 44 (see FIG. 8) in a linear motion that is parallel to the support rail and the push rail. Motor 42 is preferably a stepping motor and the control circuit 46 preferably sends a series of electrical pulses or steps to the motor to control the linear motion of the shaft. The number of pulses sent by the control circuit controls the distance the shaft 44 of the linear actuator moves. Shaft 44 preferably includes a splined section 48 such that the shaft cannot rotate relative to the motor 42.

Other forms of linear actuators may be used with the present invention, which include rack and pinion linear actuators, geared designs using chains or belts, linear motor actuators and the like. The linear actuators may also be designed with or without stepping motors. However, in the preferred design, the linear actuator includes a motor 42 that turns a threaded nut located within the linear actuator. The nut in motor 42 turns under the rotary force produced by the motor, but cannot move to the left or right. The end of shaft 44 that is inside the motor is threaded and is engaged by the nut in motor 42.

When the motor turns the nut, the shaft is moved along its own axis so that it extends or retracts from the actuator. A head 50 having a matching splined opening engages the splined section 48 of the shaft. This prevents the shaft from rotating relative to the motor as the motor turns the nut. As the motor spins the nut in one direction it pulls the shaft 44 inward. As the motor rotates in the opposite direction it pushes the shaft outward.

When the linear actuator is actively being moved by the control circuit 46, the control circuit and linear actuator are in the "driving state." When the control circuit is supplying power to the linear actuator, but is not directing the linear actuator to move from its current position, the control circuit and linear actuator are in the "holding state." When the control circuit has removed power from the linear actuator they are in the "off state."

The control circuit and linear actuator may be in the off state because power has been completely removed from the entire exit device. Alternatively, they may be in the off state when the exit device and control circuit have power connected, but the control circuit has removed power from the linear actuator.

Although non-stepping motors may be used in the linear actuator, the use of a stepping motor type linear actuator is particularly advantageous. A stepping motor requires very little current to step the motor, as compared to a solenoid-based design. This reduces the cost of wiring and hinges required to carry power to the device when the actuator is in the driving state. Another advantage is the high level of linear force that can be produced in the driving state with relatively little current.

Still another significant advantage arising from a stepping motor is that it can remain in the holding state, with the stepping motor energized but not moving, while drawing very little power and producing very little heat. When the stepping motor is in the holding state, the linear actuator is extremely resistant to being forcibly moved. This allows the linear actuator to hold the push rail in against the biasing force attempting to relatch the exit device.

When the control circuit 46 de-energizes the stepping motor completely, the linear actuator and stepping motor enter the off state. In this state, the shaft 44 can be pulled outward or pushed inward. When the shaft is moved, the threaded nut inside the actuator spins, and this produces a damping effect, which resists any rapid linear motion of the shaft. If the push rail is being held inward by the linear actuator (holding state) and the control circuit then releases it by switching to the off state, the biasing force returns the push rail to the outward position in a smooth, quiet and controlled motion resulting from the damping action of the linear actuator in the off state.

The stepping motor of the linear actuator allows the control circuit 46 to produce extremely precise control of the horizontal position of the shaft 44. The control circuit 46 moves the shaft a precise distance each time it sends an electrical stepping pulse to the stepping motor. By controlling the number of step pulses sent, the control circuit 46 controls the distance that shaft 44 moves. This, in turn, controls the location of the push rail and the extension distance of the latch bolt.

The ability of the stepping motor to hold a position with very low current when not stepping means that the linear actuator can retract the push rail 22 against the biasing force and then hold that position against the biasing force for extended periods of time. When the holding current is turned off by the control circuit 46 (off state), the biasing force on the push rail pulls the linear actuator back to its starting position and relatches the exit door 12 by extending latch bolt 18.

Referring to FIG. 8, it can be seen that the shaft 44 is secured through a pivoting connection point 52 to a retractor 54. The retractor 54 includes a retractor opening 56 that engages pin 58 on rocker lever 28. Retractor 54 extends parallel to and between two parallel sides of rocker lever 28. Pin 58 extends perpendicular to the two sides of rocker lever 28 and through the opening 56.

The opening 56 in the retractor is much larger than pin 58 and provides a lost motion connection between the linear actuator 40 and the rocker lever 28. This lost motion connection permits the exit device to be manually operated without requiring any corresponding movement of the linear actuator 40.

FIG. 8 shows the linear actuator 40 in the extended position in which the latch bolt 18 is extended (latched) and the push rail 22 is in the outward position. In this position, pressing inwards on the push rail 22 will manually open the door as previously described.

FIG. 8 illustrates the lost motion movement by depicting the rocker levers 28 and 30 partially pivoted inwards at the midpoint of a manual actuation. Due to the lost motion connection, pin 58 has moved into the middle of opening 56 without requiring any corresponding motion of the linear actuator 40. As the push rail 22 is pressed further inward it fully retracts latch bolt 18. Alternatively, the push rail may be released, in which case it will return to the outward position and pin 58 will move into the upper portion of opening 56. Thus, opening 56 provides a lost motion connection that permits mechanical operation of the exit device when the linear actuator 40 is not pulled in.

During electrical operation, control circuit 46 signals the linear actuator 40 to pull the shaft 44 left by issuing a series of control pulses to the stepper motor 42. The step pulses cause the stepper motor to rotate, which drives shaft 44 to the left in FIG. 8. The retractor, which is attached to the shaft, pulls on pin 58, which pulls the rocker lever 28 down. This motion of the rocker lever simultaneously retracts the push rail in towards the support rail 10 and pulls the latch bolt 18 inwards to open the exit door. Those in the vicinity of the exit device can immediately verify that the exit device is open by noting the inward position of the push rail 22.

The control circuit issues a specific number of step pulses to ensure that the linear actuator has moved a predetermined actuator distance. The motion of the linear actuator moves the push rail away from its initial biased outward position and towards the inward position by a corresponding push rail distance. The motion of the push rail retracts the latch bolt away from the latched position and in towards the unlatched position by a corresponding latch bolt distance.

The control circuit then holds the linear actuator at this retracted position for as long as may be desired. The stepping motor of the linear actuator and the control circuit are in the holding state. When the push rail is in the electrically retracted position the exit door can be freely opened. When pressure is applied to the push rail 22 it will already be in the fully retracted position.

As a result, the exit door 12 will swing open, but there will be no additional mechanical wear on the exit device because the rocker levers 28 and 30, the latch mechanism 14, the latch bolt 18 and the latch lever 36 will all be in the retracted position and will not move when the door is used. In high traffic areas this significantly reduces wear as compared to designs in which only the latch bolt 18 is electrically retracted and the push rail moves each time the door is used.

In addition to reducing wear, by electrically holding the push rail retracted in the holding state, the noise associated with the mechanical motion of the push rail and latch mechanism are eliminated. Yet another noise reduction occurs during the driving state as compared to earlier designs. The linear actuator design provides a very smooth progressive inward pull as compared to the abrupt, inward pull of a solenoid actuator design. This produces extremely quiet electrical operation in the driving state as compared to prior art designs.

Finally, in the off state, when the control circuit 46 removes power from the linear actuator 40, the linear actuator acts as a damper to slowly allow the push rail 22 to move outward as the threaded nut inside motor 42 spins on the internally threaded end of shaft 44. This provides a dampened smooth and extremely quiet release, which is highly desirable for exit device installations in hospitals and libraries.

In order to control the position of the push rail, the control circuit 46 must precisely send a series of stepping pulses to stepping motor 42. The number of pulses sent controls the distance that the latch bolt 18 moves. Although the number of pulses may be preset and unchangeable, in the preferred embodiment, the control circuit 46 includes an electrical adjustment via potentiometer 60, which varies the number of pulses sent to motor 42. This allows electrical adjustment of the retraction distance of the latch mechanism 14 and the latch bolt 18.

This electrical adjustment of the retraction distance of the latch bolt simplifies installation and allows changes and adjustments to accommodate wear of the exit device or in the event of any change in the distance between the exit device and the doorframe 20. This feature is particularly useful for installation and wear adjustment when the latch mechanism 14 is connected to drive vertical rods in a vertical rod door latching assembly. Vertical rod designs can be more difficult to adjust correctly and this electrical adjustment feature solves many installation problems.

A related advantage of the present invention to the adjustable throw length is that the linear actuator can be used on different products that include different latch mechanisms, different vertical rod mechanisms, and/or different locks requiring a different throw. The control circuit and/or potentiometer of adjustment 60 are simply modified to change the number of pulses sent to the linear actuator before the holding state is entered.

In a conventional electrically operated exit device, the latch is retracted when power is applied to the exit device and it relatches when power is removed. In the present invention, this functionality is provided for compatibility with third party door controls, but the control circuit 46 also implements an automatic relatch timer. In the most highly preferred embodiment, the duration of the relatch timer is adjustable via potentiometer 62.

The control circuit includes a connector 64 (see FIG. 2) through which power is supplied. In the preferred embodiment, connector 64 includes a power connection and a control connection. Power is continuously supplied to the power connection and an external switch is connected to the control connection. The switch may be a remote button for remote actuation or part of an electrical control system such as a fire control system or a security system.

With power continuously applied through the power connection, the control circuit will enter the driving state and retract the push rail when the switch connected to the control connection is closed. The latch bolt 18 will be retracted a distance determined by the setting of potentiometer 60 and the control circuit will enter the holding state to hold the push rail and latch bolt retracted.

The control circuit will remain in the holding state and the exit device will remain unlatched for as long as the remote switch connected to the control connection portion of connector 64 remains closed. When the remote switch is released, the relatch timer of the control circuit exit device will delay for a period of time according to an adjustable "time to relatch" setting determined by potentiometer 62 and then enter the off state, which releases the push rail and relatches the exit device.

This design for the control circuit allows the exit device of the present invention to simulate prior art exit device designs that do not have the adjustable time to relatch feature. Prior art designs simply unlatch when power is applied and relatch when power is removed. Simulating this operation can easily be accomplished by placing a removable jumper on the control connection to simulate a closed remote switch. In this arrangement, the exit device of the present invention is controlled by applying power to or removing power from the power connection, which provides compatibility with third party controllers that expect the exit device to unlatch when power is applied and to relatch when power is removed.

The control circuit 46 is mounted to the support rail 10 and is covered by end cap 66. Control wires (to a remote switch or controller) and power wires are connected to the system via connector 60 and extend into the door and through electrical hinges in a conventional manner. End cap 66 covers the connector and wires and a cover plate 68 covers the support rail 10 between the end cap 66 and the push rail 22 to provide a clean appearance as seen in FIG. 1.

Figure 4:
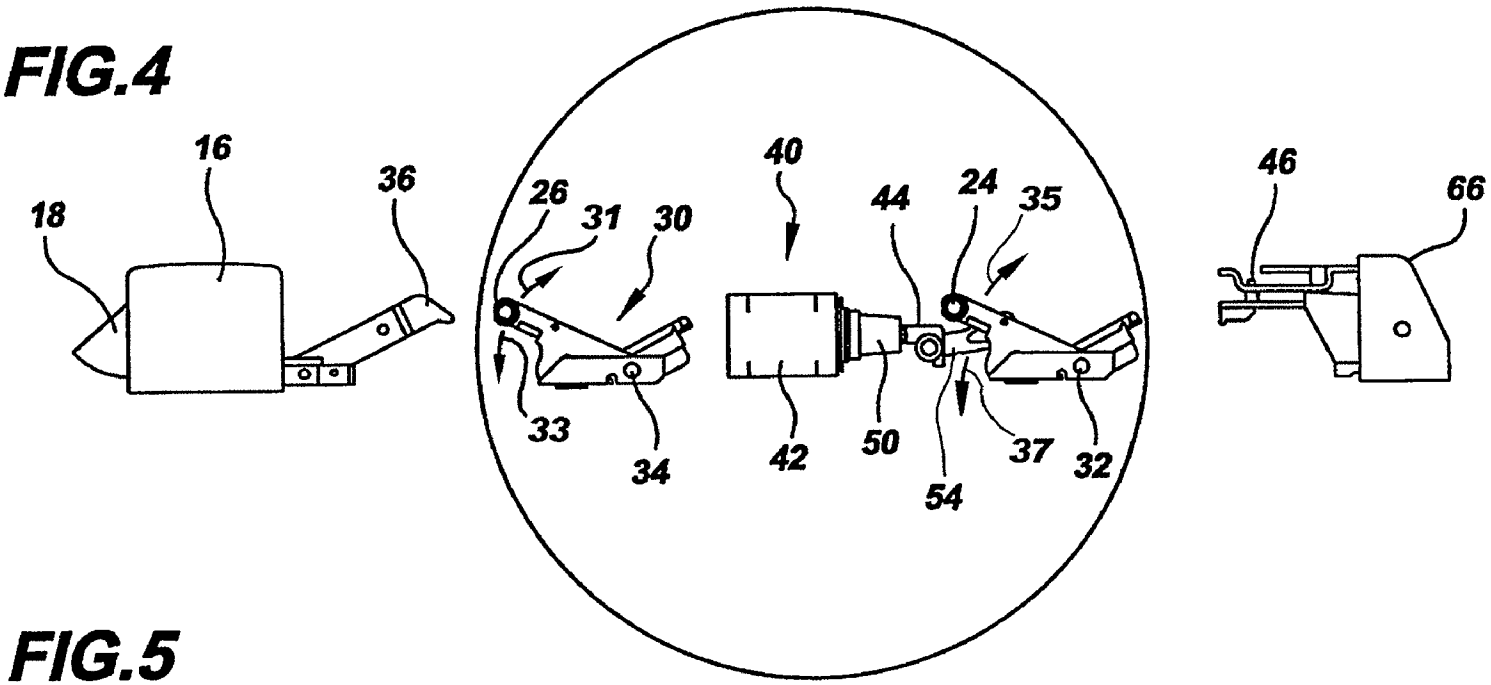
FIG. 4 is a bottom plan view illustrating the same components seen in FIG. 3 still in the electrically retracted position.

FIG. 4 shows the components described above in the electrically retracted position. The shaft 44 has been fully retracted such that the splined section 48 is substantially retracted within head 50 mounted to motor 42.

As can be seen in FIG. 5, which provides a closer view of the electrically retracted position, retractor 54 has been pulled to the left towards the linear actuator 40 and motor 42 by shaft 44. The opening 56 in the retractor has pulled on pin 58, which has pulled rocker lever 28 down. Rocker lever 30 and the push rail have followed so that the push rail is held in the fully retracted position.

Figure 6:
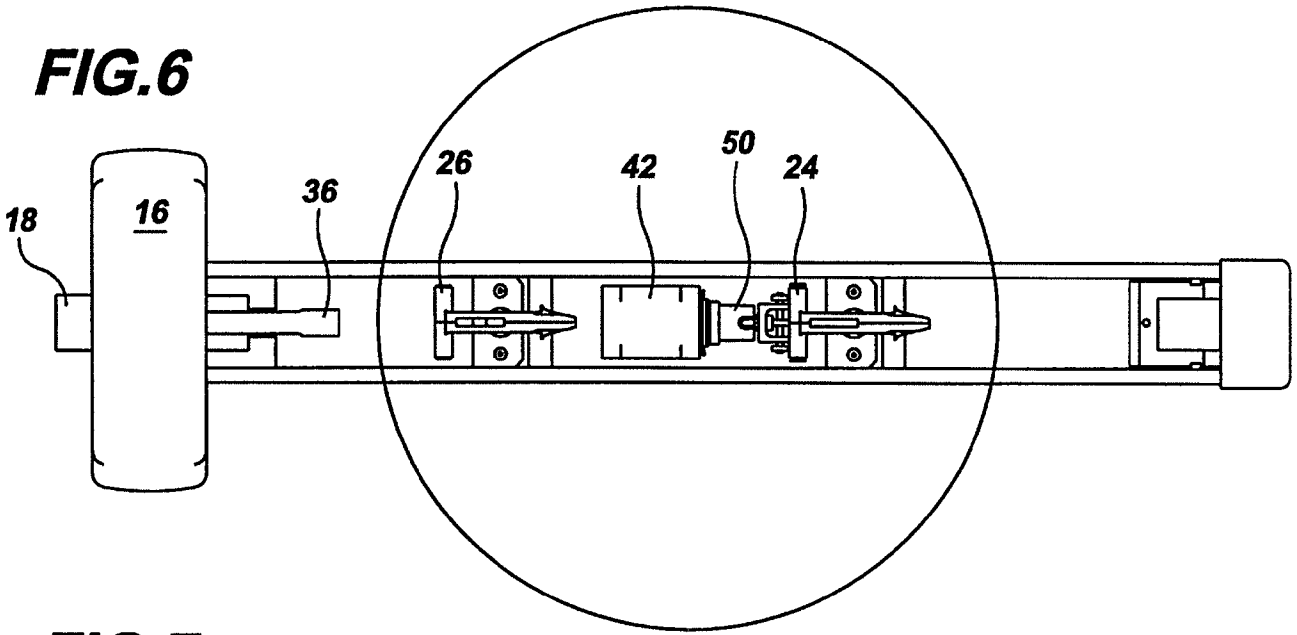
FIG. 6 is a front elevational view of the electronic push retraction exit device seen in FIG. 1. The components are shown assembled, but the push rail and cover have been removed to better show the relationship of the components. The components are shown in the electrically retracted position.
Figure 7:
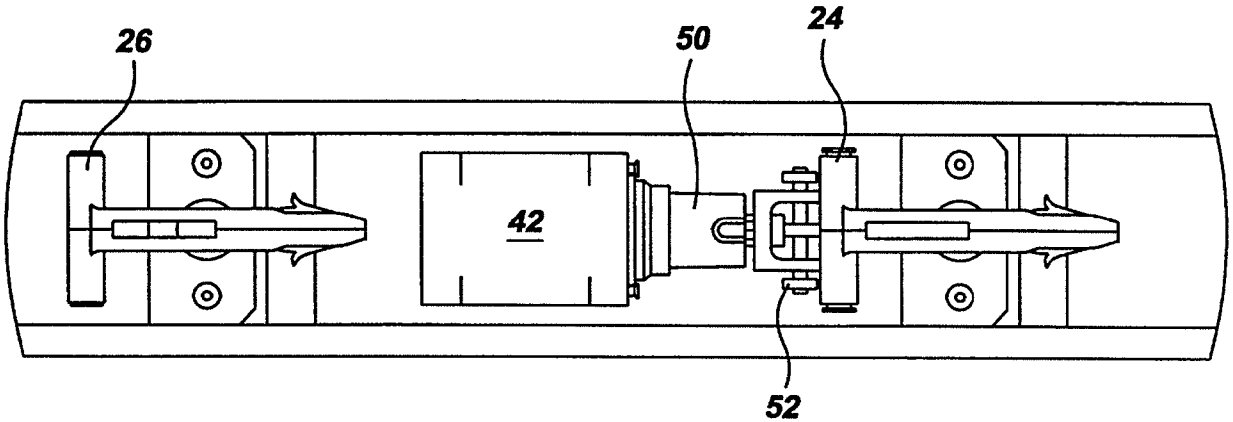
FIG. 7 is a front elevational view of the encircled components seen in FIG. 6, shown at an enlarged scale. The components are still in the electrically retracted position.

FIGS. 6 and 7 show the front view of the exit device with the push rail and cover plate 68 removed. Although the preferred design uses the linear actuator to drive the push rail to the inward position, in a second embodiment, the linear actuator may be connected directly to the latch lever 36 to directly operate the latch mechanism 14 and retract latch bolt 18 without moving the push rail to the inward position.

The linear actuator 40 of the present invention provides a compact package which fits between the two rocker levers 28, 30, such that the length of the support rail and push rail can be significantly reduced. Prior art designs have heretofore required that a motor and/or holding solenoid be mounted outside the space between the rocker levers which has resulted in a relatively long minimum length. Because the linear actuator is compact and the holding solenoid is eliminated, the exit device of the present invention can be installed on narrow doors as narrow as 26 inches (66 centimeters) in width.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An electronic push retraction exit device for latching and unlatching a door, the exit device comprising:

a support rail mountable to the door;

a push rail mounted on the support rail and movable between an outward position and an inward position, the push rail being biased towards the outward position and movable to the inward position by manually pushing on an exterior surface of the push rail;

a latch bolt operably connected to the push rail and movable between a latched position and an unlatched position, the push rail being connected to move the latch bolt to the unlatched position when the push rail is moved to the inward position;

a linear actuator including a linearly movable shaft connected to move the push rail, the shaft including a splined section preventing the shaft from rotating and the linear actuator having a driving state, an off state and a holding state, wherein:

the linear actuator moves the push rail towards the inward position when driven in the driving state, the linear actuator allows the push rail to return to the biased outward position when in the off state, and the linear actuator remains at a constant linear position and prevents the push rail from returning to the biased outward position when in the holding state; and a control circuit for controlling the linear actuator in the driving state, the holding state and the off state to move the push rail to the inward position, hold the push rail in the inward position and subsequently release the push rail to return to the outward position.

2. The electronic push retraction exit device according to claim 1 wherein the linear actuator includes a stepping motor.

3. The electronic push retraction exit device according to claim 2 wherein the control circuit provides a sequence of electrical steps to drive the stepping motor in the driving state, the control circuit holds the stepping motor at a single step position in the holding state and the control circuit removes power from the stepping motor in the off state.

4. The electronic push retraction exit device according to claim 1 wherein the control circuit drives the linear actuator a predetermined actuator distance to move the push rail away from the initial biased outward position and towards the inward position by a corresponding push rail distance and move the latch bolt away from the latched position and towards the unlatched position by a corresponding latch bolt distance.

5. The electronic push retraction exit device according to claim 4 wherein the control circuit further includes an actuator distance adjustment, the actuator distance adjustment allowing adjustment of the predetermined actuator distance to adjust the distance the linear actuator moves the push rail and the latch bolt.

6. The electronic push retraction exit device according to claim 5 wherein the linear actuator includes a stepping motor, the control circuit sends a plurality of electrical steps to the stepping motor to drive the linear actuator and the actuator distance adjustment varies the number of steps sent to the stepping motor by the control circuit to adjust the actuator distance.

7. The electronic push retraction exit device according to claim 1 wherein the control circuit further includes a relatch timer, the control circuit placing the linear actuator in the off state to relatch the exit device after a delay interval set by the relatch timer.

8. The electronic push retraction exit device according to claim 7 wherein the control circuit further includes a relatch timer adjustment, the relatch timer adjustment allowing adjustment of the delay interval of the relatch timer.

9. The electronic push retraction exit device according to claim 1 further including a connector connected to the control circuit, the connector having a power connection and a control connection, the control circuit moving the push rail to the inward position and the latch bolt to the unlatched position responsive to an input signal at the control connection.

10. The electronic push retraction exit device according to claim 1 further including a connector connected to the control circuit, the connector having a power connection and a control connection adapted for connection to a switch:

the control circuit moving the push rail to the inward position and the latch bolt to the unlatched position when the switch is closed and power is supplied to the power connection; and the control circuit releasing the push rail to return to the outward position when the switch is closed and power is not supplied to the power connection.

11. An electronic push retraction exit device for latching and unlatching a door, the exit device comprising:

a support rail mountable to the door;

a push rail mounted on the support rail and movable between an outward position and an inward position, the push rail being biased towards the outward position and movable to the inward position by manually pushing on an exterior surface of the push rail;

a latch bolt operably connected to the push rail and movable between a latched position and an unlatched position, the push rail being connected to move the latch bolt to the unlatched position when the push rail is moved to the inward position;

a linear actuator connected to move the push rail through a lost motion connection, the lost motion connection allowing the push rail to move to the inward position by manually pushing on the exterior surface of the push rail without moving the linear actuator, the linear actuator having a driving state, an off state and a holding state, wherein:

the linear actuator moves the push rail towards the inward position when driven in the driving state, the linear actuator allows the push rail to return to the biased outward position when in the off state, and the linear actuator remains at a constant linear position and prevents the push rail from returning to the biased outward position when in the holding state; and a control circuit for controlling the linear actuator in the driving state, the holding state and the off state to move the push rail to the inward position, hold the push rail in the inward position and subsequently release the push rail to return to the outward position.

12. The electronic push retraction exit device according to claim 11 wherein the linear actuator is connected to a rocker lever connected between the support rail and the push rail, the lost motion connection comprising a retractor with an opening, the opening engaging with the rocker lever and allowing lost motion between the push rail and the linear actuator.

13. The electronic push retraction exit device according to claim 12 wherein the opening in the retractor engages a pin in the rocker lever.

14. The electronic push retraction exit device according to claim 11 wherein the lost motion connection between the linear actuator and the push rail comprises a retractor with an opening, the retractor being pivotally connected to the linear actuator and the opening allowing lost motion between the push rail and the linear actuator.

15. The electronic push retraction exit device according to claim 11 wherein the linear actuator includes a stepping motor.

16. The electronic push retraction exit device according to claim 15 wherein the control circuit provides a sequence of electrical steps to drive the stepping motor in the driving state, the control circuit holds the stepping motor at a single step position in the holding state and the control circuit removes power from the stepping motor in the off state.

17. The electronic push retraction exit device according to claim 11 wherein the control circuit drives the linear actuator a predetermined actuator distance to move the push rail away from the initial biased outward position and towards the inward position by a corresponding push rail distance and move the latch bolt away from the latched position and towards the unlatched position by a corresponding latch bolt distance.

18. An electronic push retraction exit device for latching and unlatching a door, the exit device comprising:

a support rail mountable to the door;

a push rail mounted on the support rail and movable between an outward position and an inward position, the push rail being biased towards the outward position and movable to the inward position by manually pushing on an exterior surface of the push rail;

a latch bolt operably connected to the push rail and movable between a latched position and an unlatched position, the push rail being connected to move the latch bolt to the unlatched position when the push rail is moved to the inward position;

a linear actuator connected to move the push rail, the linear actuator having a driving state, an off state, and a holding state, wherein:

the linear actuator moves the push rail towards the inward position when driven in the driving state, the linear actuator allows the push rail to return to the biased outward position when in the off state, and the linear actuator remains at a constant linear position and prevents the push rail from returning to the biased outward position when in the holding state; and a control circuit for controlling the linear actuator in the driving state, the holding state and the off state to move the push rail to the inward position, hold the push rail in the inward position and subsequently release the push rail to return to the outward position;

wherein the push rail is mounted on a pair of rocker levers and the linear actuator is mounted between the rocker levers.

19. The electronic push retraction exit device according to claim 18 wherein the exit device has a length less than or equal to 26 inches.

20. An electronic push retraction exit device for latching and unlatching a door, the exit device comprising:

a support rail mountable to the door;

a pair of rocker levers mounted to the support rail;

a push rail mounted to the rocker levers on the support rail and movable between an outward position and an inward position, the push rail being biased towards the outward position and movable to the inward position by manually pushing on an exterior surface of the push rail;

a latch bolt operably connected to the push rail and movable between a latched position and an unlatched position, the push rail being connected to move the latch bolt to the unlatched position when the push rail is moved to the inward position:

a linear actuator having a stepping motor driving a shaft and a retractor mounted on the end of the shaft, the retractor being connected to at least one of the rocker levers; and a control circuit for controlling the linear actuator, the control circuit having a driving state, a holding state, and an off state wherein:

the control circuit controls the linear actuator to move the push rail towards the inward position in the driving state, the control circuit controls the linear actuator to release the push rail to return to the biased outward position when in the off state, and the control circuit controls the linear actuator to remain at a constant linear position and prevent the push rail from returning to the biased outward position when in the holding state; and wherein the retractor includes an opening making a lost motion connection between the linear actuator and the at least one rocker lever.

21. The electronic push retraction exit device according to claim 20 wherein the retractor is pivotally connected to the linear actuator.

22. The electronic push retraction exit device according to claim 20 wherein the opening in the retractor engages a pin in the at least one rocker lever.

23. The electronic push retraction exit device according to claim 20 wherein the control circuit provides a sequence of electrical steps to drive the stepping motor in the driving state, the control circuit holds the stepping motor at a single step position in the holding state and the control circuit removes power from the stepping motor in the off state.

24. The electronic push retraction exit device according to claim 20 wherein the shaft includes a splined section, the splined section preventing the shaft from rotating.

25. The electronic push retraction exit device according to claim 20 wherein the retractor is pivotally connected to the linear actuator.

26. The electronic push retraction exit device according to claim 20 wherein the control circuit further includes an actuator distance adjustment and responsive thereto, the control circuit sends a variable number of pulses to the stepping motor to adjust the distance the linear actuator moves the push rail and the latch bolt.

27. The electronic push retraction exit device according to claim 20 wherein the control circuit further includes a relatch timer, the control circuit entering the off state to relatch the exit device after a delay interval set by the relatch timer.

28. The electronic push retraction exit device according to claim 27 wherein the control circuit further includes a relatch timer adjustment, the relatch timer adjustment allowing adjustment of the delay interval of the relatch timer.

* * * * *